US005342447A

United States Patent [19]

Nudo et al.

[11] Patent Number: 5,342,447

[45] Date of Patent: Aug. 30, 1994

[54] PAINT GUIDE

[75] Inventors: Alexander S. Nudo; Timothy Nudo; Patrick R. Nudo, all of Springfield, Ill.

[73] Assignee: Nudo Products, Inc., Springfield, Ill.

[21] Appl. No.: 52,070

[22] Filed: Apr. 22, 1993

[51] Int. Cl.[5] ..... B05C 11/00

[52] U.S. Cl. ..... 118/504; 118/301

[58] Field of Search ..... 118/505, 504, 213, 301, 118/506; 482/282; 51/274

[56] References Cited

U.S. PATENT DOCUMENTS

| | | | |
|---|---|---|---|
| 1,563,889 | 12/1925 | Zastrow | 118/505 |
| 2,453,863 | 11/1948 | Salisbury | 118/504 |
| 2,698,003 | 12/1954 | Bullock | 118/504 |
| 2,812,784 | 11/1957 | Palmer | 118/504 |
| 4,258,654 | 3/1981 | Ivankovich | 118/504 |
| 5,056,458 | 10/1991 | Askeland | 118/505 |

*Primary Examiner*—W. Gary Jones
*Assistant Examiner*—Brenda Adele Lamb
*Attorney, Agent, or Firm*—Philip L. Bateman

[57] ABSTRACT

A paint guide is particularly suited for use in painting large, exterior surfaces such as parking lots, warehouse floors, walkways, and curbs. The paint guide is formed of two frames, each having a rectangular planar base with at least one longitudinal side defining a planar surface perpendicular to the base. Each frame has an upright member at both of its latitudinal sides. The two frames are connected together at the upright members with releasable fastening means. Both the angle and the distance between the two bases can be adjusted so that the guide can be used both on flat surfaces and on outside corners.

3 Claims, 3 Drawing Sheets

PAINT GUIDE

FIELD OF THE INVENTION

This invention relates to painting and coating devices. More particularly, this invention relates to paint guides used for masking and stenciling.

BACKGROUND OF THE INVENTION

A common step in painting and other coating operations is to place a covering over an area not to be painted, while leaving uncovered the area to be painted. A wide variety of stencils, masks, guards, shields, guides, etc., have been disclosed for such use. For example, Ivankovich, U.S. Pat. No. 4,258,654, issued Mar. 31, 1981, discloses a paint guard for protecting a baseboard from dripping paint as the wall is painted. Askeland, U.S. Pat. No. 5,056,458, issued Oct. 15, 1991, discloses a painting shield which prevents paint from dropping on the floor between door jambs.

Lines are routinely painted on parking lots, warehouse floors, etc., to indicate traffic and storage patterns. Curbs and outside corners are also routinely painted to contrast them with their surroundings and thereby reduce the chances of accidental collisions. Such areas are often painted using masking tape. However, applying and then removing the tape is a time-consuming operation and the tape cannot, of course, be reused. A second method of painting such areas is to draw lines, e.g., with a chalk line, and then simply try to paint within the lines. The precision of the line is inversely proportional to the time spent. Accordingly, it would desirable to have a reusable paint guide which could be used in such situations to quickly and accurately paint the desired areas.

SUMMARY OF THE INVENTION

A general object of this invention is to provide an improved paint guide. More particular objects are to provide a paint guide which is reusable, lightweight, easy-to-use, and adjustable so it can be used on flat surfaces and on outside corners to paint areas of varying widths.

I have invented an improved paint guide. The paint guide is adjustable to define an area for painting on a flat surface or on an outside corner. The paint guide comprises: (a) a first and a second frame; each frame having a rectangular planar base with at least one longitudinal side defining a planar surface perpendicular to the base so that, when a base is placed on its side on a flat surface, close contact is made between the side and the surface; each frame also having an upright member at each of its latitudinal sides, each upright member having a height at least about the width of the base; and (b) releasable fastening means for connecting the two upright members of the first frame to the corresponding two upright members of the second frame in an overlapping relationship so that the angle between the two bases can be adjusted throughout the range from perpendicular to parallel and also so that the distance between the two bases can be adjusted.

The paint guide of this invention is especially useful in painting large surfaces such as parking lots, warehouse floors, walkways, and curbs. The guide is adjustable so it can be used on flat surfaces and on outside corners such as curbs. It is also adjustable to varying widths. The paint guide is reusable, lightweight, and easy to use and to adjust. Use of the paint guide enables large areas to be painted quickly and accurately.

DETAILED DESCRIPTION OF THE INVENTION

Figure 1:
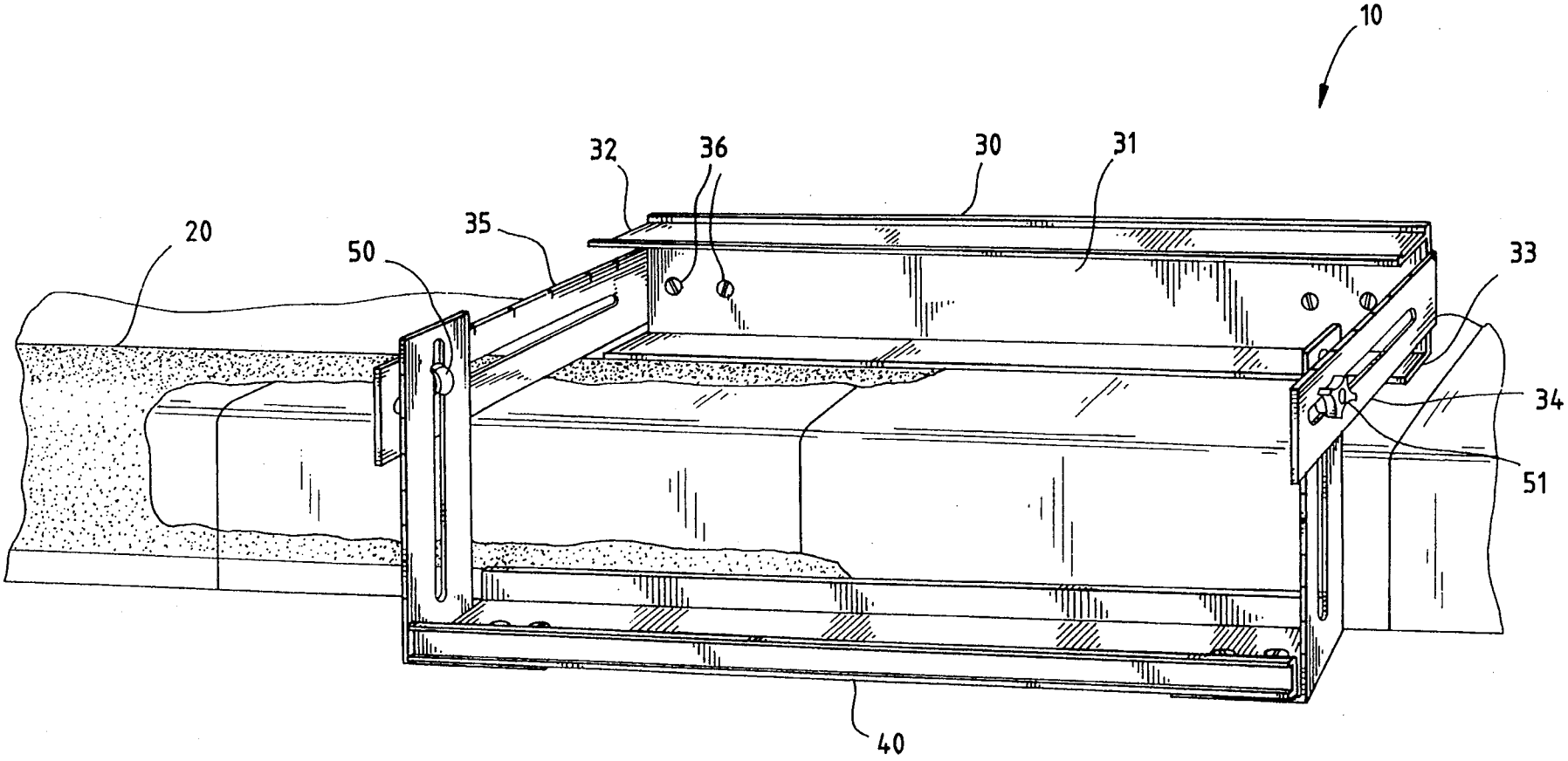
FIG. 1 is a perspective view of one embodiment of the paint guide of this invention in a position to guide the painting of a curb.

This invention is best understood by reference to the drawings. In FIG. 1, the paint guide 10 is shown in use during the painting of a curb 20. The paint guide is made of two matching frames 30 and 40. The frames are made of a lightweight, yet strong material. Plastics are suitable materials: they are lightweight, but tend to be relatively brittle and prone to breaking. Steels are also suitable: they are strong, but are relatively heavy and also susceptible to rust. The preferred material is extruded aluminum. An especially preferred material is an anodized, extruded aluminum having a wall thickness of about 0.05 inches. Each frame is about 1 to 10 feet long. Longer lengths are sometimes desirable, but the guide becomes progressively heavier, more awkward to use, and more difficult to store as the length increases. The preferred length for most painting operations is about 2 to 4 feet. The width of each base is about 1 to 8 inches, preferably about 2 to 4 inches.

Figure 3:
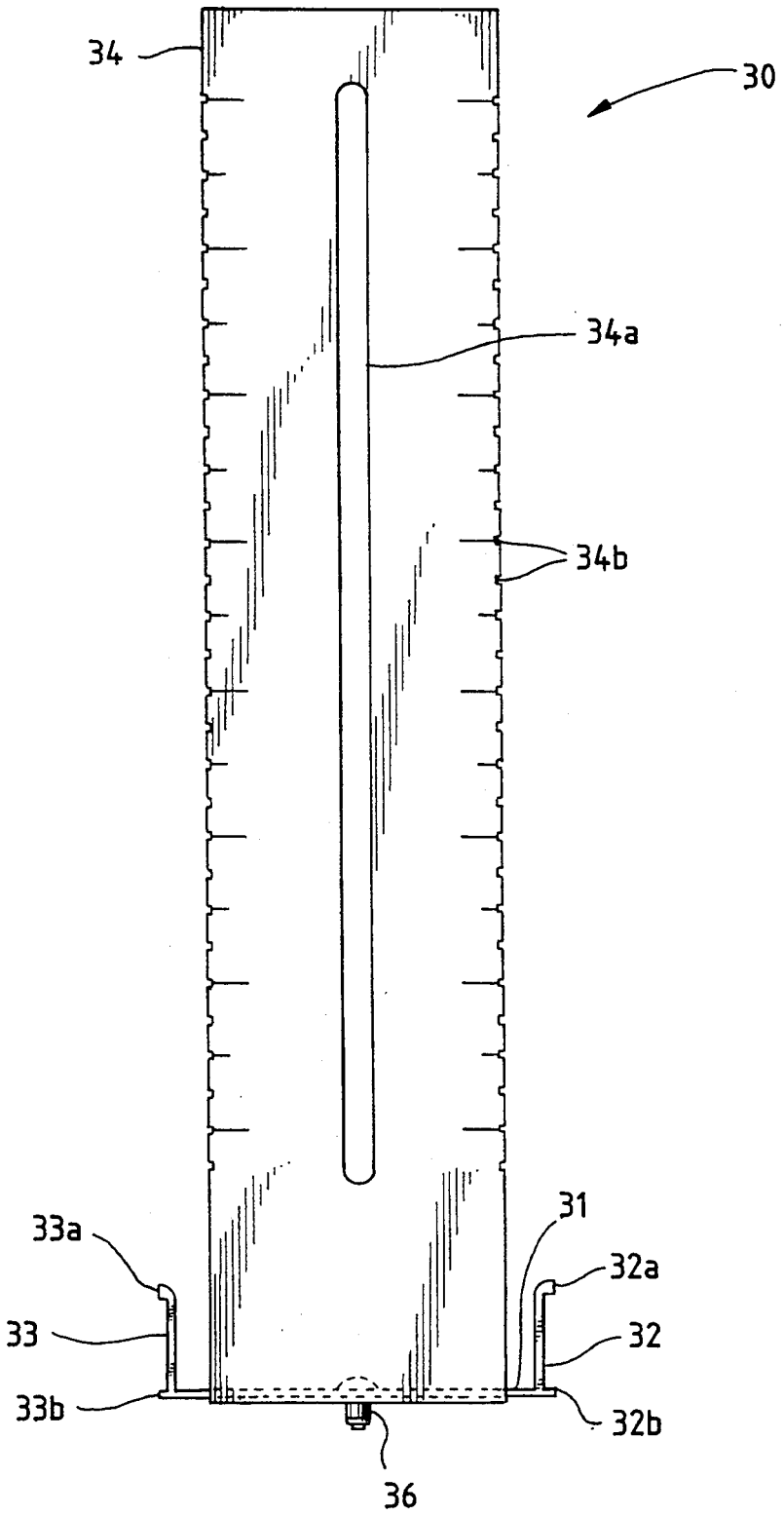
FIG. 3 is an end view of one of the two frames forming a part of the paint guide shown in FIGS. 1 and 2.

The end of the first frame is shown in detail in FIG. 3. The frame contains a rectangular planar base 31. Flanges 32 and 33 run the longitudinal length of the base. Although not essential to the functioning of the paint guide, the flanges help stiffen the base. The flanges may be of different heights or they may be the same height (as shown in FIG. 3). The flanges are generally about 0.5 to 2 inches in height. Each flange contains two ribs, **32*a* and 32*b*, and 33*a* and 33*b*, respectively. The ribs help stiffen the flange and also define a planar surface which is perpendicular to the plane of the base. As can be seen most clearly in FIG. 1**, when the paint guide is used, it is the top ribs which actually make the close contact with the surface being painted at the point where the paint ends. The ribs make closer contact to the surface than would a ribless flange because the ribs are not affected by minor peaks and imperfections in the surface to be painted in the area between the two ribs.

At the latitudinal sides of the first frame are upright members 34 and 35 which are used to connect the two frames together. The upright members are generally formed of the same material as the base and have a height at least about the width of the base. In general, the upright members have a height of about 4 to 12 inches. The upright members are attached to the base with screws 36 passing through a lip of the upright member and the base. The upright members of the two frames mate with each other in an overlapping relationship. For this purpose, the upright members in the embodiment shown contain slots (identified as character **34*a* in the member shown in FIG. 3) through which threaded member 50 passes. The threaded member is secured and tightened with knob 51. A series of equally-spaced notches (identified as character 34*b* in the member shown in FIG. 3**) provide a convenient means for adjusting the paint guide to the desired width, as explained below.

Figure 2:
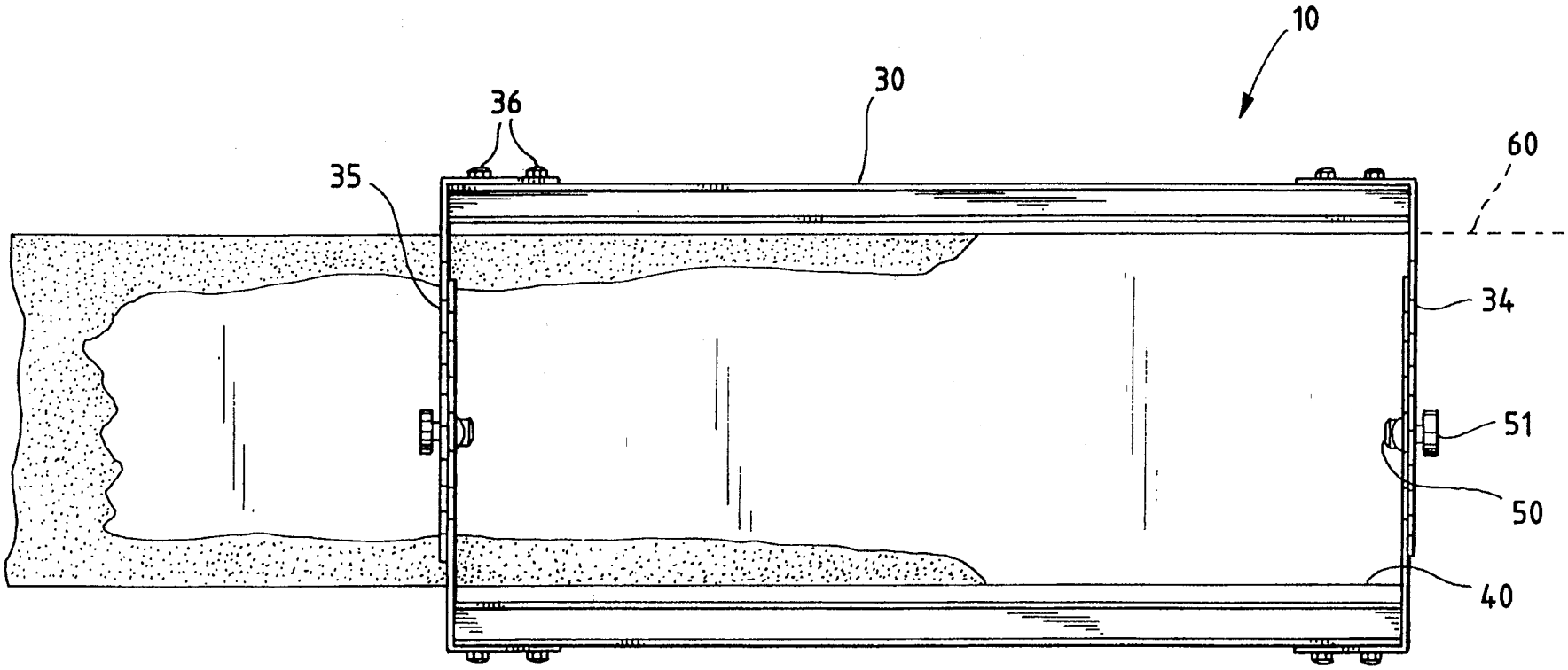
FIG. 2 is a perspective view of the embodiment shown in FIG. 1 in a position to guide the painting of a flat surface.

The adjustable nature of the paint guide is seen by comparing FIG. 1 with FIG. 2. In FIG. 1, the bases of the two frames are perpendicular and the guide is adapted for use in painting a curb. In FIG. 2, the two bases are parallel and the guide is adapted for use in painting a flat surface. A chalk line 60 applied to the surface is used to position the guide. In either configuration, the distance between the two bases (and the width of the area to be painted) is adjusted by simply changing the overlap of the upright members. Distance adjustments are facilitated by the use of the notches or other distance markings on the upright members themselves.

The paint guide is used by setting it in position and then painting the area between the bases. The guide is then moved to a different position down the line. Some painters may prefer to paint only the trim with the guide in place (as shown in FIGS. 1 and 2) and then paint the interior after the guide has been moved. Some painters may also prefer to affix masking tape to the upward face of the flanges to prevent paint from getting on the guide itself. It can be seen that the distance between the two bases is limited to a range of roughly the height of an upright member (when the members overlap the maximum amount) to roughly double the height of an upright member (when the members overlap the minimum amount). The guide is still useful in painting stripes of widths outside this range. One edge is painted and the base is then simply moved toward or away from the line and the other edge is painted.

We claim:

1. A paint guide which is adjustable to define an area for painting on flat surfaces or on outside comer surfaces, the paint guide comprising:

(a) a first frame having a horizontal rectangular planar base with a vertical flange along each longitudinal side, the frame also having a vertical upright member having a height equal to or greater than the width of the base at each latitudinal side of the base in between the two flanges so that, when the frame is placed on its side on a horizontal flat surface with the flanges horizontal, one of the flanges makes close contact with the surface while the other flange and the two upright members make no contact with the surface;

(b) a second frame having a horizontal rectangular planar base with a vertical flange along each longitudinal side, the frame also having a vertical upright member having a height equal to or greater than the width of the base at each latitudinal side of the base in between the two flanges so that, when the frame is placed on its side on a horizontal flat surface with the flanges horizontal, one of the flanges makes close contact with the surface while the other flange and the upright members make no contact with the surface; and (c) releasable fastening means for connecting the two upright members of the first frame to the corresponding two upright members of the second frame in an overlapping relationship so that the angle between the two bases can be adjusted throughout the range from perpendicular to parallel and also so that the distance between the two bases can be adjusted.

2. The paint guide of claim 1 wherein each flange contains a plurality of ribs pointing away from the base.

3. The paint guide of claim 1 wherein the upright members contain slots running at least about one-half the length of the member, which upright members are fastened together with threaded members passing through the slots.

* * * * *